US006884094B1

(12) United States Patent
Bernhart et al.

(10) Patent No.: US 6,884,094 B1
(45) Date of Patent: Apr. 26, 2005

(54) CONNECTOR WITH HERMAPHRODITIC CENTER GROUND PLANE

(75) Inventors: William Henry Bernhart, Mount Joy, PA (US); John A. Fulponi, Harrisburg, PA (US); Russell David Moser, Lewisberry, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/705,585

(22) Filed: Nov. 10, 2003

(51) Int. Cl.[7] ..... H01R 4/66
(52) U.S. Cl. ..... 439/101; 439/609
(58) Field of Search ..... 439/101, 108, 439/607, 608, 609, 610, 95, 939

(56) References Cited

U.S. PATENT DOCUMENTS 5,120,232 A * 6/1992 Korsunsky ..... 439/108
5,195,899 A * 3/1993 Yatsu et al. ..... 439/101
6,074,225 A * 6/2000 Wu et al. ..... 439/101

* cited by examiner

*Primary Examiner*—Ross Gushi

(57) ABSTRACT

An electrical connector assembly includes a receptacle, a first ground plane partitioning the receptacle, a plug configured to mate with the receptacle, and a second ground plane partitioning the plug. Each of the first and second ground planes are in mechanical and electrical contact with one another when the plug is mated to the receptacle.

18 Claims, 6 Drawing Sheets

CONNECTOR WITH HERMAPHRODITIC CENTER GROUND PLANE

BACKGROUND OF THE INVENTION

This invention relates generally to electrical connectors, and, more particularly, to electrical connectors having internal ground contacts.

It is sometimes desirable to provide socket-type connectors which interface one electrical system with another. For example, in a vehicle, an electrical socket receptacle may be provided as an interface between the electrical system of the vehicle and an external device, such as a radio which facilitates bi-directional communication between occupants of the vehicle and remote radio operators. For high powered radio systems, such as for military use and aviation use, the receptacle may include a large number of contacts to be engaged with corresponding pins of a mating plug connector. One connector, for example, includes five rows of connector contacts, with each row including twenty four contacts. The contacts include power contacts, ground contacts, and signal contacts.

Due to the large number of contacts in the receptacle and plug, substantial insertion and extraction forces are typically encountered when attempting to mate and unmate the plug to the receptacle. Large insertion and extraction forces are undesirable because it is difficult to ensure that the plug and receptacle are properly engaged. If the plug and receptacle are not properly engaged, performance and reliability of the radio system may be compromised. Additionally, from time to time it is necessary to disengage the plug from the receptacle, for example, to make repairs to the radio and/or the vehicle, and difficulties in removing the plug can frustrate such endeavors.

Additionally, the electronics in some systems may be particularly vulnerable to electrostatic discharge (ESD) when the plug connector is unmated from the socket receptacle. The human body can build up static charges perhaps as large as 25,000 volts or more, and these buildups can discharge rapidly, generating a voltage discharge through the connector to sensitive electronic components. This is particularly a concern with digital equipment.

BRIEF DESCRIPTION OF THE INVENTION

According to an exemplary embodiment, an electrical connector assembly is provided. The electrical connector assembly comprises a receptacle, a first ground plane partitioning the receptacle, a plug configured to mate with the receptacle, and a second ground plane partitioning the plug. Each of the first and second ground planes are in mechanical and electrical contact with one another when the plug is mated to the receptacle.

Optionally, the first ground plane and the second ground plane are inverted relative to one another, and each of the first and second ground planes comprise hermaphroditic surfaces. A conductive shell may surround at least one of the plug and the receptacle, and at least one of the first and second ground planes may be electrically connected to the shell. The first and second ground planes may comprise a ribbed surface, the ribbed surfaces of the first and second ground planes may receive one another when the plug and the receptacle are mated.

According to another embodiment, an electrical connector assembly is provided. The connector assembly comprises a receptacle comprising a first shell, a receptacle insert received in the first shell, and a first ground plane extending through a center of the receptacle insert. The first ground plane is configured for connection to a circuit board on one end and has a plug engagement surface. A plug comprises a second shell, a plug insert received in the second shell, and a second ground plane extending through a center of the plug. The second ground plane is configured for connection to a circuit board on one end and has a receptacle engagement surface. The plug is configured to mate with the receptacle, thereby mechanically and electrically engaging the plug engagement surface to the receptacle engagement surface.

According to another exemplary embodiment, an electrical connector is provided. The connector includes a plug and a receptacle configured for mating engagement with one another, and a ground plane is substantially centered within each of the plug and receptacle. The ground planes of the plug and the receptacle comprise hermaphroditic surfaces mechanically and electrically engaging one another when the plug and the receptacle are mated. At least one of the ground planes is mechanically and electrically connected to a conductive shell.

DETAILED DESCRIPTION OF THE INVENTION

Figure 1:
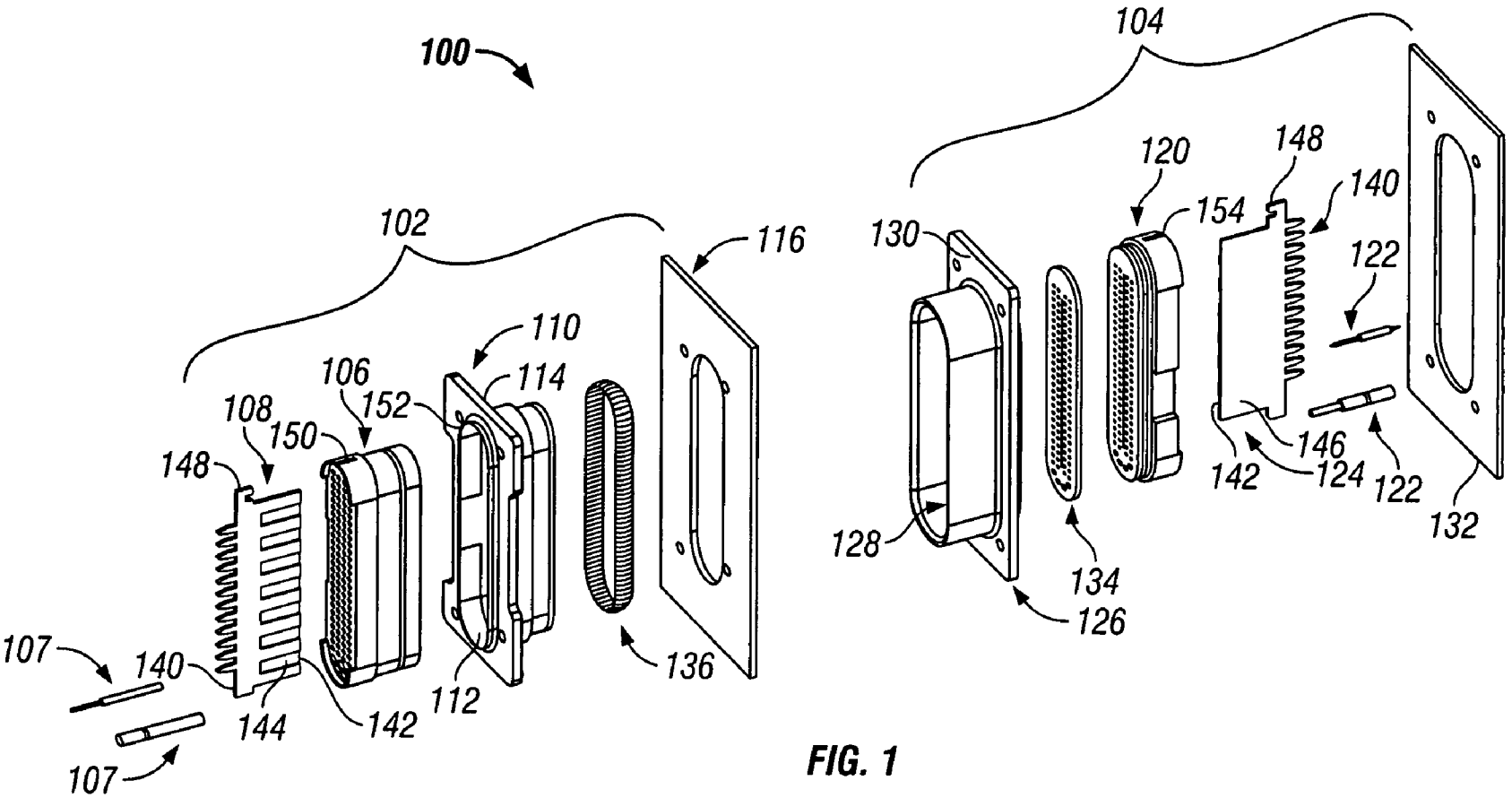
FIG. 1 is an exploded view of a connector formed in accordance with an exemplary embodiment of the invention.

FIG. 1 is an exploded view of a connector 100 formed in accordance with an exemplary embodiment of the invention. The connector 100 includes a receptacle assembly 102 and a plug assembly 104 which, in an exemplary embodiment, transmits signals in a differential pair communications system which may be employed in, for example, a high powered radio system. While the invention is described in the context of a particular connector 100, it is understood that the concepts and teaching of the present invention may find application in a variety of connectors beyond the specific embodiments illustrated herein, including non-differential pair connectors. The connector 100 is therefore provided for illustrative purposes only and is not intended to limit the invention to any particular connector, such as connector 100, or to any particular end use or application.

The receptacle assembly 102 includes a receptacle insert 106 having a number of socket contacts 107 fitted therein, and a ground plane 108 is received within the receptacle insert 106 in the manner explained below. The receptacle insert 106 is received in a conductive shell 110 within a cavity 112 which has a complementary shape to the receptacle insert 106. A mounting flange 114 is provided on the shell 110 for securing the shell 110 to a panel 116, which may be a part of or secured to a cabinet of an electrical system, such as, for example, a radio system.

The plug assembly 104 includes a plug insert 120 having a number of pin contacts 122 fitted therein, and a ground plane 124 is received within the plug insert 120 in the manner explained below. The plug insert 120 is received in a conductive shell 126 within a cavity 128 which has a complementary shape to the plug insert 120. A mounting flange 130 is provided on the shell 126 for securing the shell 126 to a panel 132, which in one embodiment may be part of or secured to a bulkhead (not shown). An interfacial seal 134 is provided adjacent the receptacle insert and includes a number of apertures therethrough for passage of the pin and socket connections of the plug insert 120 and the receptacle insert 106 when the plug assembly 104 is mated to the receptacle assembly 102. An EMI grounding spring 136 ensures connection of the shells 110 and 126 and reduces electromagnetic interference in the connector 100.

The ground planes 108 and 124 of the respective receptacle assembly 102 and the plug assembly 104 provides a center contact path between the plug assembly 104 and the receptacle assembly 102 when mated to one another. As illustrated in FIG. 1, each of the ground planes 108, 124 includes a connector end 140 and an engagement end 142. Each of the ground planes 108, 124 further includes opposed textured engagement surfaces 144 and smooth surfaces 146 on the opposite facing sides of the respective ground planes 108 and 124 The engagement surfaces 144 are hermaphroditic as described below and mechanically and electrically engage one another to form a continuous ground plane through the receptacle assembly 102 and the plug assembly 104 when mated to one another. The ground plane 108 eliminates ground socket contacts in the receptacle insert 106 and the ground plane 124 eliminates ground pin contacts in the plug insert 120. In the illustrated embodiment, twenty four mating ground socket contacts and twenty four mating ground pin contacts are replaced by the respective ground planes 108 and 124. By eliminating a large number of pin and socket ground contacts which would otherwise be necessary in the connector 100, the ground planes 108 and 124 provide a substantial reduction in applied force to mate the plug assembly 104 with the receptacle assembly 102.

A contact portion 148 is provided adjacent each of the connector ends 140 of the ground planes 108 and 124. The contact portion 148 of the ground plane 108 is received in a slot 150 in the receptacle insert 106 and contacts a rim 152 of the shell 110 to establish an electrical connection therewith. The contact portion 148 of the ground plane 124 is received in a slot 154 in the plug insert 120 and contacts a rim (not shown in FIG. 1) of the shell 130. Conductive paths are therefore provided directly from the respective ground planes 108 and 124 to the shells 110 and 126, which ultimately are electrically connected to a chassis ground, sometimes referred to as a hardware ground, of the associated electrical system. Advantageously, the conductive paths from the ground planes 108 and 124 to the shells 110 and 126 minimizes the effects of electrostatic discharge (ESD) as the connector 100 is handled. ESD is dissipated in the shells 110 and 126 to the chassis ground and directed away from sensitive electronic components on either side of the connector 100 (i.e., electronic components associated with the receptacle assembly 102 and the plug assembly 104).

Figure 2:
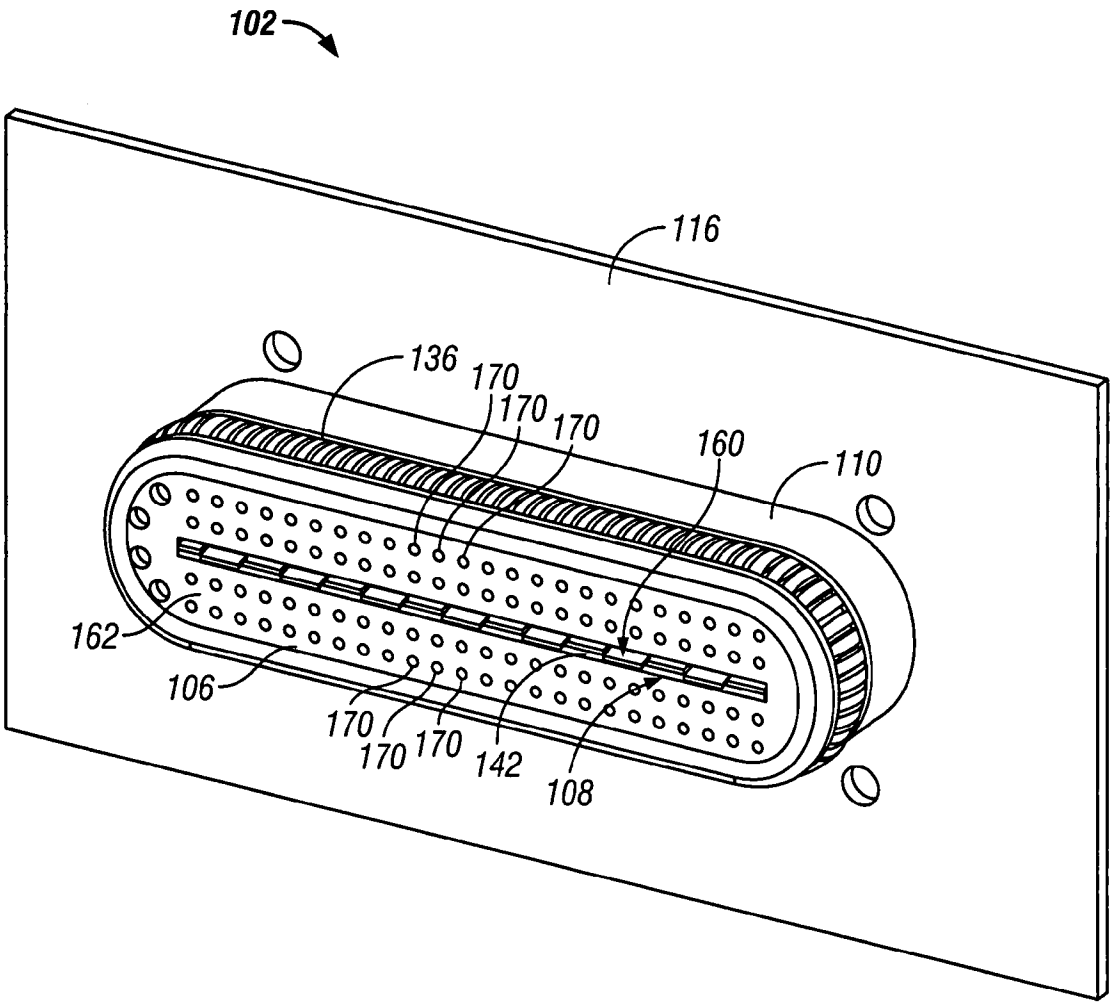
FIG. 2 is a perspective view of a receptacle assembly for the connector shown in FIG. 1.

FIG. 2 is a perspective view of the receptacle assembly 102 illustrating the shell 110 extended through the panel 116. The receptacle insert 106 is contained within the shell 110 and includes a number of socket apertures 170 therein which extend to a respective socket contact 107 (shown in FIG. 1) in the receptacle insert 106. Thus, when pin contacts 122 (shown in FIG. 1) of the plug assembly 104 (shown in FIG. 1) are inserted into the socket apertures 170, the pin contacts 122 and the socket contacts 107 mechanically and electrically engage one another. In one embodiment, there are four rows of socket apertures 170 with each of the rows including twenty four apertures 170, although it is understood that more or less socket apertures 170 and socket contacts 107 may be employed in various embodiments.

The ground plane 108 is press fit into a slot 160 in the receptacle insert 106, and when the ground plane 108 is inserted into the slot 160, the ground plane 108 substantially subdivides or partitions the receptacle insert 106 into two equal halves. That, is the ground plane 108 extends in a generally central location with an approximately equal number of socket apertures 170 located on either side of the ground plane 108. For example, in an embodiment including four rows of socket apertures 170, two of the rows are located on one side of the ground plane 108 and two of the rows are located on the other side of the ground plane 108. Symmetrical placement of the ground plane 108 within the contact field of the receptacle insert 106 facilitates a microstrip environment within the receptacle insert 106 while providing acceptable signal integrity, ESD (electrostatic discharge) and EMI characteristics.

In an alternative embodiment, the ground plane 108 may be positioned off center for a non-symmetrical contact field within the receptacle insert 106, although such positioning of the ground plane may result in a bias in certain portions of the contact field.

The engagement end 142 of the ground plane 108 is positioned substantially flush with an outer surface 162 of the receptacle insert 106. A portion of the engagement surface 144 of the ground plane 108 is exposed within the slot 160 for mating engagement with the ground plane 124 (shown in FIG. 1) of the plug assembly 104 (shown in FIG. 1). The EMI spring 136 is extended around the shell 110 proximate the receptacle insert 106. When the plug assembly 104 (shown in FIG. 1) is mated to the receptacle assembly 102, the spring 136 ensures electrical connection between the shells 110 and 126.

Figure 3:
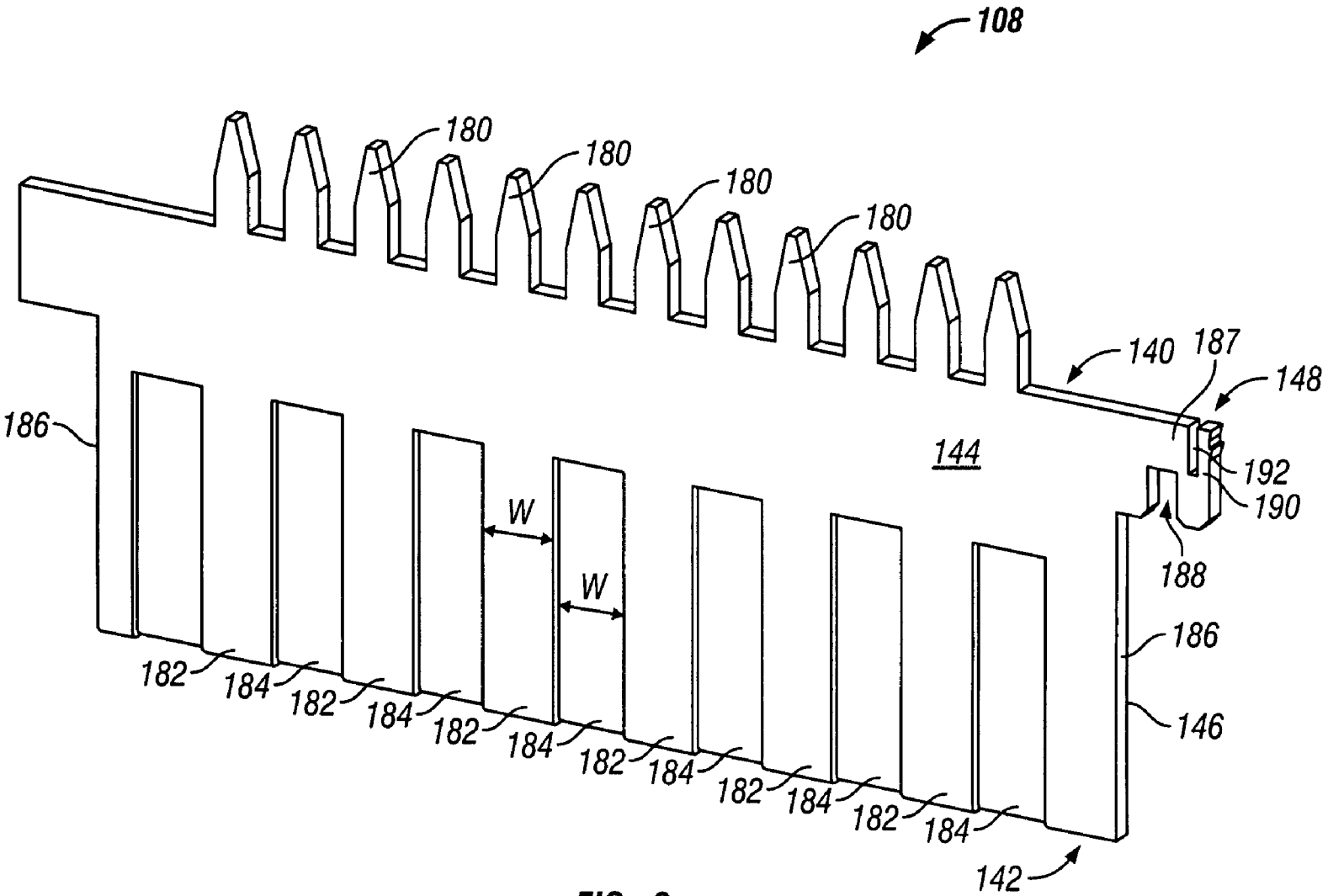
FIG. 3 is a perspective view of a center ground plane for the receptacle assembly shown in FIG. 2.

FIG. 3 is a perspective view of the ground plane 108 for the receptacle assembly 102 (shown in FIGS. 1 and 2). The connector end 140 includes a number of solder tails 180 adapted for through hole connection to a circuit board (not shown). It is understood, however, that in an alternative embodiment the connector end 140 may be adapted for connection to a circuit board, flex circuit or other device via surface mounting techniques or other known connection schemes in lieu of through-hole mounting.

The engagement end 142 extends in a direction opposite from the connector end 140, and the smooth surface 146 extends on an opposite side of the ground plane 108 from the engagement surface 144. As illustrated in FIG. 3, the engagement surface 144 in an exemplary embodiment is defined by an alternating series of ribs 182 and grooves or slots 184. The ribs 182 and the grooves 184 therebetween share an approximately equal with W in one embodiment, and the grooves 184 are depressed or recessed relative to the ribs 182 such that the engagement surfaces 144 of each of the ground plane 108 and the ground plane 124 (shown in FIG. 1) may be fitted together in an interlocking manner with the ribs 182 of one of the ground planes fitted within the grooves 184 of the other ground plane.

The contact portion 148 extends from the connector end 140 and one of the lateral edges 186 of the ground plane 108.

The contact portion 148 includes a hook 187 having a slot 188 therein. The hook 187 engages the slot 150 (shown in FIG. 1) in the receptacle insert 106 (shown in FIG. 1) and also the rim 152 (shown in FIG. 1) of the shell 110 (shown in FIG. 1) to establish electrical contact between the ground plane 108 and the shell 110. A resilient catch 190 is provided adjacent the hook 187. The catch includes a slot 192 therein which allows the catch 190 to deflect relative to the hook 187 and slightly enlarge the slot 188 in the hook 187 for insertion or release of the hook 187 with respect to the shell 110.

While one exemplary contact portion 148 has been described, it is understood that other shapes of contact portions 148 may be employed in alternative embodiments while achieving similar benefits. For example, a simple cantilever beam could be provided which extends from the connector end 140 toward the shell 110 (shown in FIG. 1) and making electrical contact therewith.

In an exemplary embodiment, the ground plane 108 is fabricated from a single sheet of conductive material, such as copper, according to known fabrication methods and techniques, including but not limited to stamping and cutting operations. As desired, the ground plane 108 may be coated, plated, or overlaid with a conductive material or alloy, including but not limited to gold and tin alloys, familiar to those in the art. Alternatively, the ground plane 124 may be fabricated from multiple conductive sheet materials or conductive elements to form a composite ground plane.

Figure 4:
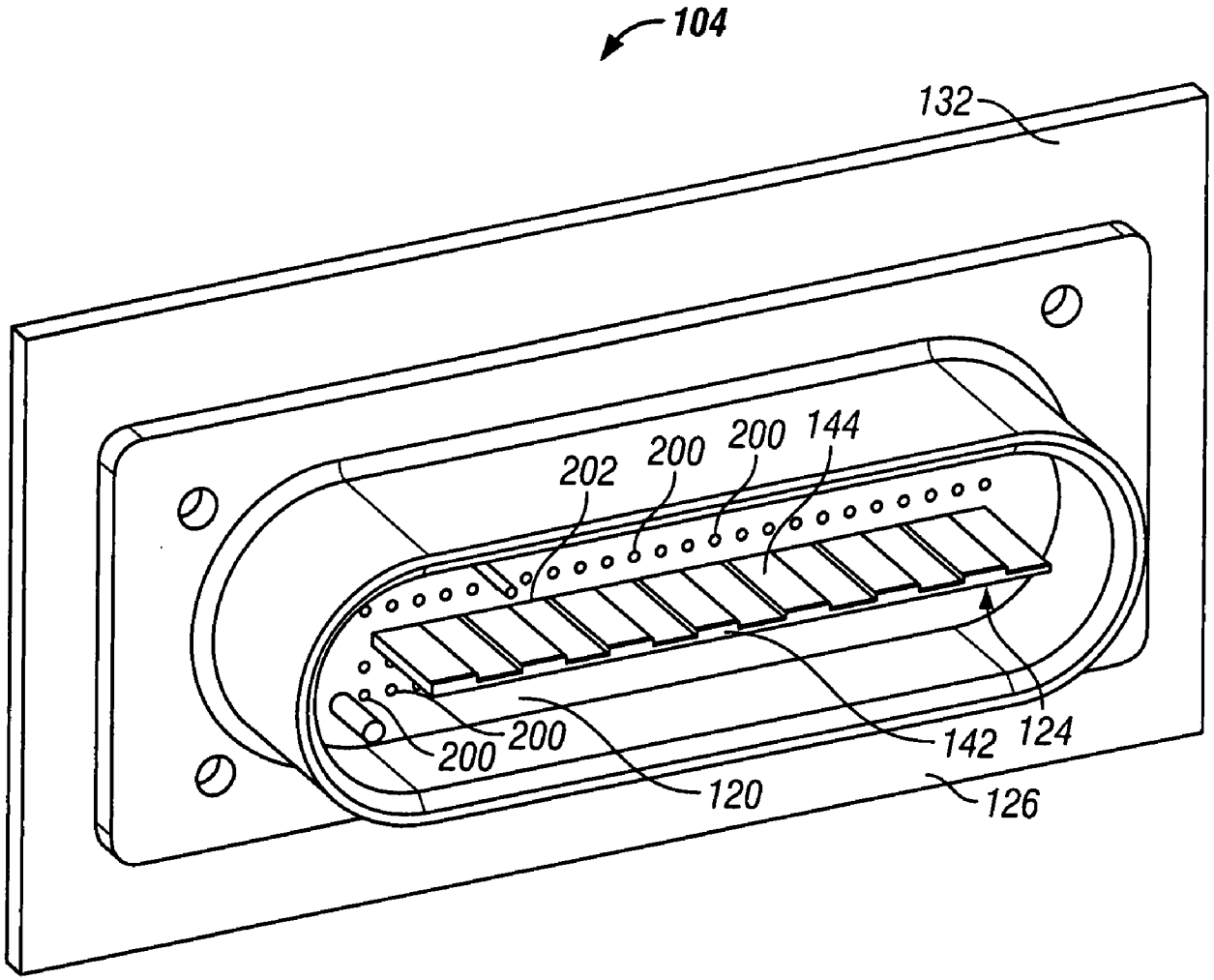
FIG. 4 is a perspective view of a plug assembly for the connector shown in FIG. 1.

FIG. 4 is a perspective view of the plug assembly 104 illustrating the shell 126 extended through the panel 132. The plug insert 120 is contained within the shell 126 and includes a number of pin apertures 200 therein which receive respective pin contacts 122 (shown in FIG. 1) in the plug insert 120. In one embodiment, there are four rows of socket apertures 200 with each of the rows including twenty four apertures 200, although it is understood that more or less pin apertures 200 and pin contacts 122 may be employed in various embodiments.

The ground plane 124 is press fit into a slot 202 in the plug insert 120, and when the plug insert 120 is fitted into the slot 202 the ground plane 124 substantially subdivides or partitions the plug insert 120 into two equal halves. That, is the ground plane 124 extends in a generally central location with an approximately equal number of pin apertures 200 located on either side of the ground plane 124. For example, in an embodiment including four rows of pin apertures 200, two of the rows are located on one side of the ground plane 124 and two of the rows are located on the other side of the ground plane 124. Symmetrical placement of the ground plane 124 within the contact field of the plug insert 120 facilitates a microstrip environment within the plug insert 120 with acceptable signal integrity, ESD and EMI characteristics.

In an alternative embodiment, the ground plane 124 may be positioned off center for a non-symmetrical contact field within the plug insert 120, although such positioning of the ground plane 124 may result in a bias in certain portions of the contact field.

The engagement end 142 of the ground plane 124 extends outward from the plug insert 120 so that a portion of the engagement surface 144 is exposed within the shell 126 for mating engagement with the ground plane 108 (shown in FIGS. 1–3) of the receptacle assembly 102 (shown in FIGS. 1 and 2). Extension of the ground plane 124 from the plug insert 120 also provides a physical barrier to prevent electrical contact with the pin contacts 122 which extend from the pin apertures 200 to a lesser extent than the ground plane 124. That is, the pin contacts 122 are recessed relative to the ground plane 124 within the shell 126. Therefore, when the plug assembly 104 is unplugged, a degree of safety is provided to personnel as physical contact with pin contacts 122 is prevented. A user may not inadvertently touch conductive contact pins in the receptacle insert 106, and any potential shock hazard due to powered components or accumulated voltages in circuitry associated with the plug assembly 104 is therefore avoided. Additionally, because the ground plane 124 extends further from the plug insert 120 than the pin contacts 122, potential ESD is transmitted to the ground plane 124 before reaching the pin contacts 122 extending from the plug insert 120, thereby protecting sensitive electronic components from damage.

Figure 5:
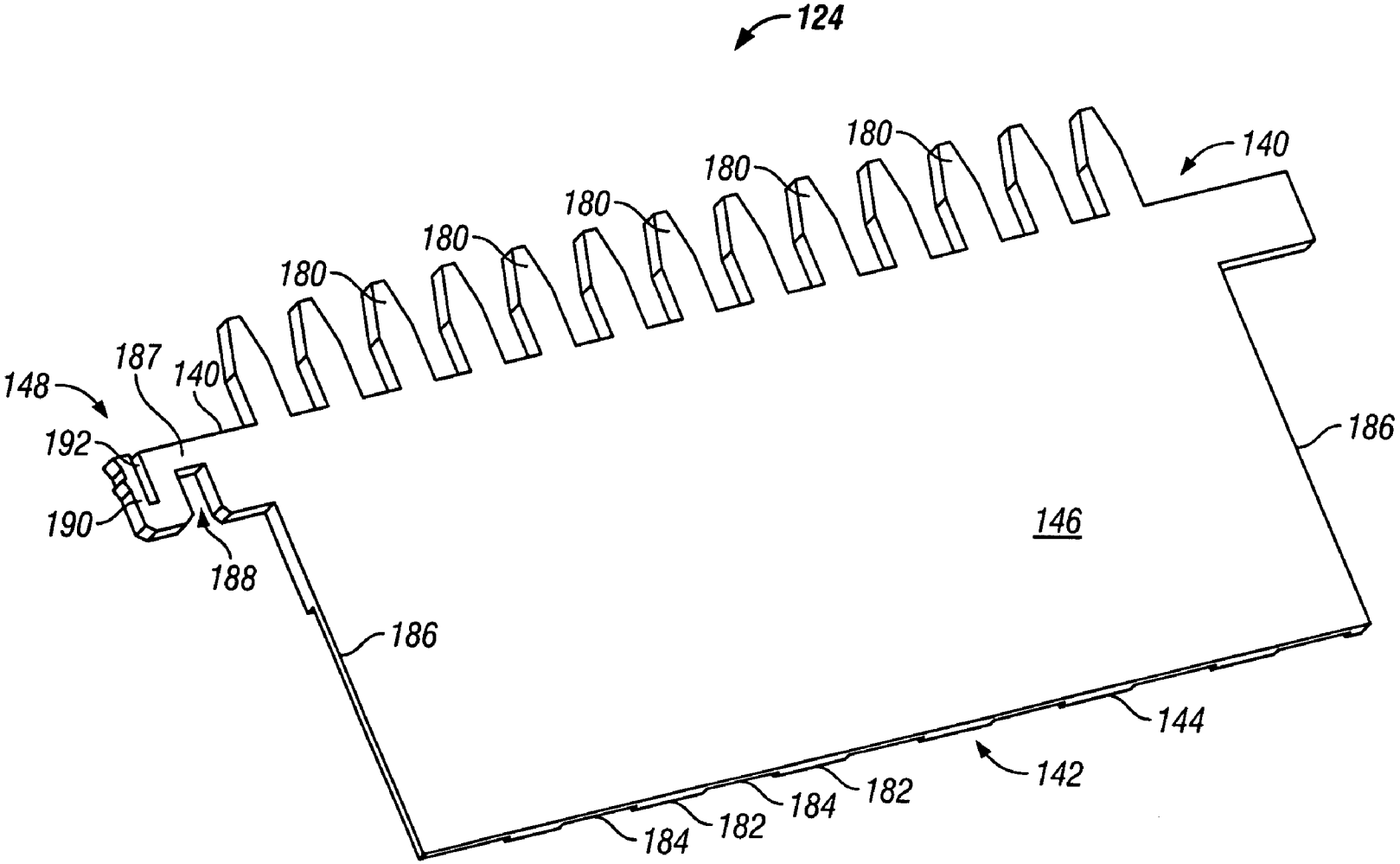
FIG. 5 is a perspective view of a center ground plane for the plug assembly shown in FIG. 4.

FIG. 5 is a perspective view of the ground plane 124 for the plug assembly 104 (shown in FIGS. 1 and 4). The connector end 140 includes a number of solder tails 180 adapted for through hole connection to a circuit board (not shown). It is understood, however, that in an alternative embodiment the connector end 140 may be adapted for connection to a circuit board, flex circuit or other device via surface mounting techniques or other known connection schemes in lieu of through-hole mounting.

The engagement end 142 extends in a direction opposite from the connector end 140, and the smooth surface 146 extends on a side of the ground plane 124 opposite from the engagement surface 144. As illustrated in FIG. 5, the engagement surface 144 in an exemplary embodiment is defined by an alternating series of ribs 182 and grooves 184.

The contact portion 148 of the ground plane 124 extends from the connector end 140 and one of the lateral edges 186 of the ground plane 124. The contact portion 148 includes a hook 187 having a slot 188 therein. The hook 187 engages the slot 154 (shown in FIG. 1) in the plug insert 120 (shown in FIG. 1) and also the shell 126 (shown in FIGS. 1 and 4) to establish electrical contact between the ground plane 124 and the shell 126. A resilient catch 190 is provided adjacent the hook 187. The catch includes a slot 192 therein which allows the catch 190 to deflect relative to the hook 187 and slightly enlarge the slot 188 in the hook 187 for insertion or release of the hook 187 with respect to the shell 126.

In an exemplary embodiment, the ground plane 124 is fabricated from a single sheet of conductive material, such as copper, according to known fabrication methods and techniques, including but not limited to stamping and cutting operations. As desired, the ground plane 124 may be coated, plated, or overlaid with a conductive material or alloy, including but not limited to gold and tin alloys, familiar to those in the art. Alternatively, the ground plane 124 may be fabricated from multiple conductive sheet materials or conductive elements to form a composite ground plane.

Figure 6:
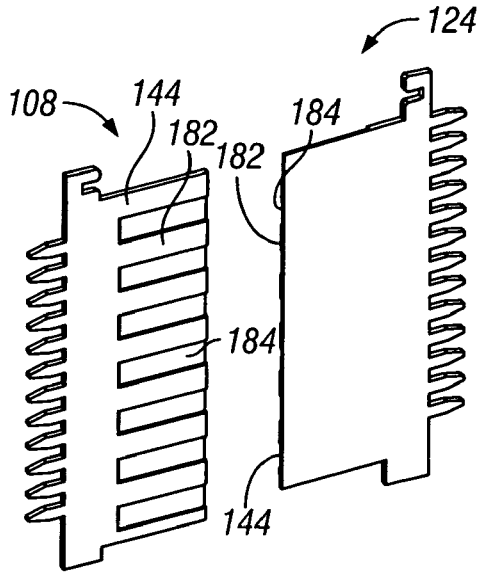
FIG. 6 is a perspective view of the center ground planes shown in FIGS. 3 and 5 aligned for engagement with one another.

FIG. 6 is a perspective view of the center ground planes 108 and 124 aligned for engagement with one another. The ground planes 108 and 124 are inverted relative to one another such that the engagement surface 144 of the ground plane 108 faces the engagement surface 144 of the ground plane 124. The ribs 182 of the ground plane 108 are aligned with the grooves 184 of the ground plane 124, and the grooves 184 of the ground plane 108 are aligned with the ribs 182 of the ground plane 124. In this position, the engagement surfaces 144 are aligned to make wiping contact with one another as they are brought together.

The engagement surfaces 144 of the ground planes 108 and 124 are hermaphroditic or self mating to ensure electrical contact with one another and with low insertion force as the plug assembly 104 (shown in FIG. 1) is mated with the receptacle assembly 102 (shown in FIG. 1). While the illustrated embodiment employs a keyed or tongue and groove arrangement for the hermaphroditic engagement surfaces 144, it is appreciated that other shapes and configurations of the engagement surfaces 144 may be provided to complement one another and mechanically and electrically engage one another with wiping contact in alternative embodiments of the invention.

Figure 7:
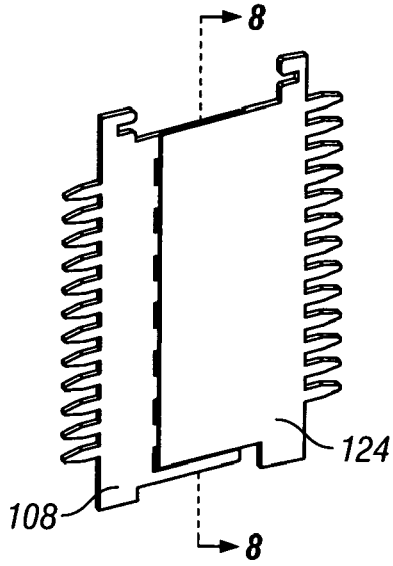
FIG. 7 is a perspective view of the center ground planes shown in FIG. 6 in an engaged position.
Figure 8:
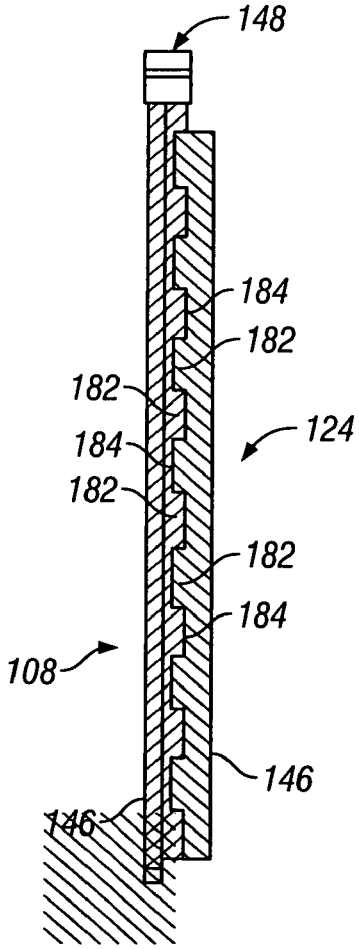
FIG. 8 is a cross sectional view of the center ground planes shown in FIG. 7 along line 8—8.

FIGS. 7 and 8 illustrate the ground planes 108 and 124 mechanically and electrically engaged to one another. The ribs 182 of each of the ground planes 108 and 124 are received in the respective grooves 184 of the other ground plane, and the smooth surfaces 146 of the ground planes 108 and 124 are substantially parallel to one another. The interlocking ribs 182 and grooves 184 ensure reliable mechanical and electrical connection between the ground planes 108 and 124 within the connector 100 (shown in FIG. 1).

The above described ground planes 108 and 124 provide a number of advantages in a connector having a large number of pin and socket connections, such as the connector 100 (shown in FIG. 1). For example, the ground planes 108 and 124 reduce the number of pins in the connector and therefore reduce insertion force in mating the receptacle assembly 102 (shown in FIG. 1) and the plug assembly 104 (shown in FIG. 1). The contact portions 148 of the ground planes 108 and 124 provide a conductive path to the shells 110 and 126 (shown in FIG. 1) which minimizes effects of ESD. The ground plane 124 of the plug assembly 104 prevents electrical contact with pin contacts 122 (shown in FIG. 1) when the plug assembly and the receptacle assembly 104 and 102 are unmated. The ground planes 108 and 124 further enhance signal integrity through the connector 100 and provide adequate electromagnetic interference (EMI) characteristics and noise reduction.

The ground planes 108 and 124 further may find application in a variety of connectors, including but not limited to input/output connectors, cable assembly connectors, and connectors having insulation displacement contacts.

While the invention has been described in terms of various specific embodiments, those skilled in the art will recognize that the invention can be practiced with modification within the spirit and scope of the claims.

What is claimed is:

1. An electrical connector assembly comprising:

a receptacle;

a first ground plane partitioning the receptacle;

a plug configured to mate with said receptacle; and a second ground plane partitioning said plug;

wherein each of said first and second ground planes are in mechanical and electrical contact with one another when said plug is mated to said receptacle, and further wherein each of said plug and said receptacle comprise a conductive shell and said first and second ground planes each comprise a slot therein, said slots of said ground planes fitted into a respective slot in each of said plug and said receptacle, thereby electrically connecting each of said first and second ground planes to a respective one of said shells.

2. An electrical connector assembly in accordance with claim 1 wherein said first ground plane partitions said receptacle into two substantially equal halves.

3. An electrical connector assembly in accordance with claim 1 wherein said second ground plane partitions said plug into two substantially equal halves.

4. An electrical connector assembly in accordance with claim 1 wherein said first ground plane and said second ground plane are inverted relative to one another.

5. An electrical connector assembly in accordance with claim 1 wherein said first and second ground planes comprise hermaphroditic surfaces.

6. An electrical connector assembly in accordance with claim 1 further comprising a conductive shell surrounding at least one of said plug and said receptacle, wherein at least one of said first and second ground planes is electrically connected to said shell.

7. An electrical connector in accordance with claim 1 wherein each of said first and second ground planes comprise a ribbed surface, said ribbed surfaces of each of said first and second ground planes mechanically and electrically engaging each other when said plug is mated to said receptacle.

8. An electrical connector in accordance with claim 1 wherein each of said first and second ground planes comprises a ribbed surface, said ribbed surfaces of said first and second ground planes engaging one another when said plug and said receptacle are mated.

9. An electrical connector in accordance with claim 1 wherein each of said ground planes are configured for connection to a circuit board.

10. An electrical connector in accordance with claim 1 wherein each of said plug and receptacle comprises a conductive shell and said first and second ground plane comprises a hook, said hooks of said first and second ground planes received over an edge of said shell to establish electrical connection thereto.

11. An electrical connector assembly comprising:

a receptacle comprising a first shell, a receptacle insert received in said first shell, and a first ground plane extending through a center of said receptacle insert, said first ground plane configured for connection to a circuit board on one end and having a plug engagement surface; and a plug comprising a second shell, a plug insert received in said second shell, and a second ground plane extending through a center of said plug, said second ground plane configured for connection to a circuit board on one end and having a receptacle engagement surface;

wherein said plug is configured to mate with said receptacle, thereby mechanically and electrically engaging said plug engagement surface to said receptacle engagement surface, and further wherein one of plug engagement surface and receptacle engagement surface comprises ribs projecting therefrom, the other of said plug engagement surface and said receptacle engagement surface comprising grooves extending therein, said ribs fitted within said grooves when said plug is mated with said receptacle.

12. An electrical connector in accordance with claim 11 wherein each of said first and second ground planes is electrically connected to one of said first and second shell.

13. An electrical connector in accordance with claim 11 wherein one of said first and second ground plane is mechanically and electrically connected to a respective one of said first and second shell.

14. An electrical connector comprising:

a plug and a receptacle configured for mating engagement with one another;

a ground plane substantially centered within each of said plug and receptacle, said ground planes of said plug and said receptacle comprising hermaphroditic surfaces mechanically and electrically engaging one another when said plug and said receptacle are mated; and each of said ground planes mechanically and electrically connected to a respective conductive shell surrounding said plug and said receptacle, thereby providing a common conductive path to a hardware ground.

15. An electrical connector in accordance with claim 14 wherein each of said ground planes comprises a slot which receives a portion of said respective conductive shell.

16. An electrical connector in accordance with claim 14 wherein said hermaphroditic surfaces comprise a series of alternating ribs and grooves.

17. An electrical connector in accordance with claim 14 wherein said first ground plane and said second ground plane are configured for wiping contact with one another.

18. An electrical connector assembly comprising:

a receptacle;

a first ground plane partitioning the receptacle;

a plug configured to mate with said receptacle; and a second ground plane partitioning said plug;

wherein each of said first and second ground planes are in mechanical and electrical contact with one another when said plug is mated to said receptacle, and wherein each of said plug and receptacle comprises a conductive shell and said first and second ground plane comprises a hook, said hooks of said first and second ground planes received over an edge of said shell to establish electrical connection thereto.

* * * * *